US005827103A

United States Patent [19]

Carter

[11] Patent Number: 5,827,103

[45] Date of Patent: Oct. 27, 1998

[54] DOLLHOUSE ACTIVITY BOOK

[75] Inventor: Sharon A. Carter, Carrollton, Tex.

[73] Assignee: Sharon Carter, Weatherford, Tex.

[21] Appl. No.: 812,149

[22] Filed: Mar. 6, 1997

[51] Int. Cl.[6] ..... A63H 33/38; B42D 3/12

[52] U.S. Cl. ..... 446/71; 446/147; D19/28; 281/31

[58] Field of Search ..... 446/71–73, 75, 446/77, 147, 149; D19/28–30; 434/80, 178, 236, 238, 429; 281/31

[56] References Cited

U.S. PATENT DOCUMENTS

| | | | |
|---|---|---|---|
| D. 274,916 | 7/1984 | Hunt | D19/28 |
| 2,501,902 | 3/1950 | Howell . | |
| 3,274,706 | 9/1966 | Friend | 446/75 |
| 3,316,669 | 5/1967 | Nachbar . | |
| 3,715,816 | 2/1973 | White | 434/429 |
| 4,063,369 | 12/1977 | Hart | 35/35 |
| 4,341,521 | 7/1982 | Solomon | 434/236 |
| 4,372,077 | 2/1983 | Balbuena | 434/429 |
| 4,696,652 | 9/1987 | Reeder et al. | 446/75 |
| 4,702,700 | 10/1987 | Taylor | 434/168 |
| 4,853,994 | 8/1989 | Ekstein | 5/437 |
| 4,909,542 | 3/1990 | Marks | 281/15.1 |
| 5,387,107 | 2/1995 | Gunter et al. | 434/238 |

*Primary Examiner*—Robert A. Hafer
*Assistant Examiner*—Laura Fossum

[57] ABSTRACT

A dollhouse activity book with several pages made of a soft durable material. The pages depict rooms in a house. On the pages, pockets and straps can be found into which dollhouse family dolls may be inserted. There is also a family pet that can be moved from room to room and placed on a Velcro strip. The book is constructed in such a manner as to be very portable, with a handle at it's top.

1 Claim, 3 Drawing Sheets

Dollhouse Activity Book

DOLLHOUSE ACTIVITY BOOK

REFERENCES CITED

U.S. Patent Documents
U.S. Pat. No. 4,853,994 August 1989 Ekstein
U.S. Pat. No. 4,909,542 March 1990 Marks
U.S. Pat. No. 5,387,107 February 1995 Gunter et al
U.S. Pat. No. 4,702,700 October 1987 Taylor
U.S. Pat. No. 4,341,521 July 1982 Solomon
U.S. Pat. No. 4,063,369 December 1977 Hart
U.S. Pat. No. 3,316,669 May 1967 E. G. Nachbar
U.S. Pat. No. 3,715,816 February 1973 White
U.S. Pat. No. 2,501,902 March 1950 Howell
U.S. Pat. No. 4,696,652 September 1987 Reeder et al.
Des 274,916 July 1984 Hunt
U.S. Pat. No. 4,372,077 February 1983 Balbuena

BACKGROUND OF THE INVENTION

1. Field of the Invention

The present invention relates to the field of "Interactive picture books", but could also be considered under "Amusement Devices, Toys" being that it is a dollhouse in book form with parts that may be manipulated on the various pages.

2. Description of the Prior Art

There are several prior patents in this area, for example U.S. Pat. No. 4,853,994 issued Aug. 8, 1989 to Ekstein, which is a pillow book. It can be used as a pillow or opened up and read from like a cloth book. U.S. Pat. No. 4,909,542 issued Mar. 20, 1990 to Marks is similar but is a stuffed creature as a front cover with a book that is attached behind it and can be strapped shut.

An example of a more interactive book is U.S. Pat. No. 5,387,107 issued Feb. 7, 1995 to Gunter et al. It's a storybook used for teaching desired behavioral patterns. The main character in the book may be personalized with the likeness of the reader by applying a photograph of the reader to certain pages.

Another example of an interactive book is U.S. Pat. No. 4,702,700 issued Oct. 27, 1987 to Taylor. This book has a pocket found on the page with a set of manipulatives that are used to attach to the page by a magnetic means. It has a variety of educational uses involving word association and matching.

U.S. Pat. No. 4,341,521 issued Jul. 27, 1982 to Solomon is an interactive book using a series of puppets depicting different emotions. A child reads the story on the page and then affixes the puppet to the page with the emotion that the child believes the character is feeling.

Some additional U.S. Pat. Nos. that are over 20 years old that are interactive type books are No. 4,063,369 issued Dec. 20, 1977 to Hart. This one provides the child with several manipulative to create his own story; No. 3,316,669 issued May 2, 1967 to E. G. Nachbar, which features a book that is used as an educational device with removable and interchangeable parts; No. 3,715,816 issued Feb. 13, 1973 to White is similar to the previous patent in that it is educational with removable and interchangeable parts, but has to do with animals and what they eat; No. 2,501,902 issued Mar. 28, 1950 to J. B. Howell is also an educational book featuring a bear on each page that teaches a child the various processes of securing together articles of clothing.

The remaining U.S. Patents that I will cite pertain more to the category of Amusement Devices (Toys). U.S. Pat. No. 4,696,652 issued September 1987 to Reeder et al is a device or toy that when opened up replicates a Post Office and has some loose components to be used in play. U.S. Pat. No. Des. 274,916 issued Jul. 31, 1984 to Hunt is a design that has the look of a house with a fold-out book inside. U.S. Pat. No. 4,372,077 issued Feb. 8, 1983 to Dora O. Balbuena is an hand puppet with a folded flannel board inside that has a pocket for the flannel board figures. A storybook is also included.

SUMMARY OF INVENTION

In summary this invention is a Dollhouse in book form with pockets and manipulatives. It includes a front cover and a back cover with a plurality of pages there between. The pages are bound together with string, ribbon or such on one side, and on the other a Velcro strap is used to secure it shut. There is a handle at top for ease in carrying around.

The front cover features a large pocket with the appearance of a house on it, into which a doll family may be inserted for storage. The following pages depict rooms in a house, such as, the Family Room, Dining Room, Master Bedroom, Girls Room, and Nursery. On the pages are pockets and straps into which the Doll family figures may be inserted. In addition there is a family pet that moves from room to room on a Velcro strip.

Figure 1:
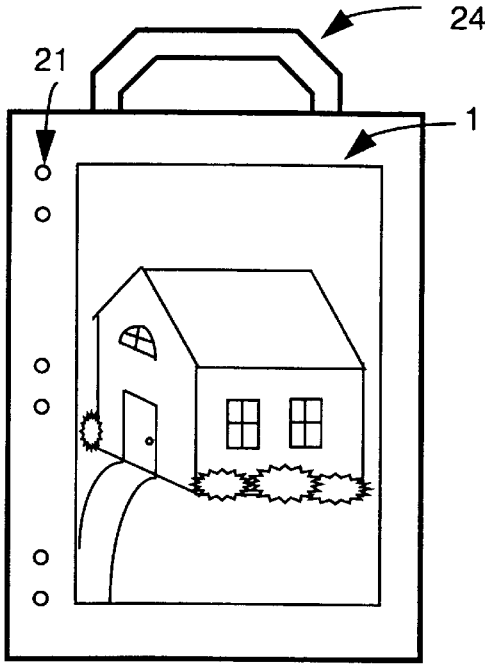
FIG. 1—Front of book

Reference Numeral in Drawings:

1—Pocket opening

2—Couch pocket opening

3—Bookshelf

4—TV

5—Bookshelf

6—chair pocket opening

7—Strap to hold baby in swing

8—Pet with Velcro on back

9—High chair tray is strap to hold baby in

10—Pocket for one doll at table

11—Pocket for one doll at table

12—Pocket for one doll at table

13—Pocket for items for table settings

14—Chair pocket opening

15—Bed pocket opening for two dolls

16—Pocket for Big Sister's items

17—Pocket for Big Sister doll

18—Oval piece of material with hole in middle to insert baby

19—Pocket in crib to insert baby

20—Pocket for baby's toys

21—Eyelets to use in binding book together

22—Table made of flannel or felt like material

23—Table settings made of flannel or felt like material

24—Handles

25—Baby swing

DESCRIPTION OF THE PREFERRED EMBODIMENT(S)

The front of the book, which is illustrated in FIG. 1, is comprised mainly of one large pocket used for holding all of the Dollhouse dolls when not in use. This pocket can be secured shut so that none of the dolls would be used while transporting. Most pockets in this book are made by attaching a piece of material to the page on three sides, leaving the top part open to insert items. Eyelets 21 are used to help bind the book together, with the use of a shoelace, ribbon or small rope.

Figure 2:
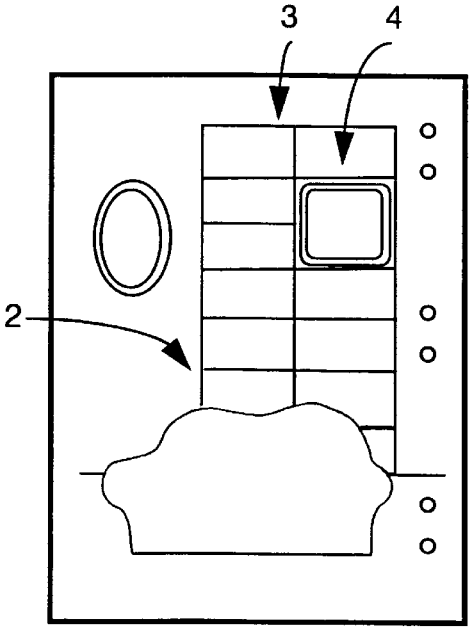
FIGS. 2 & 3—Family room
Figure 3:
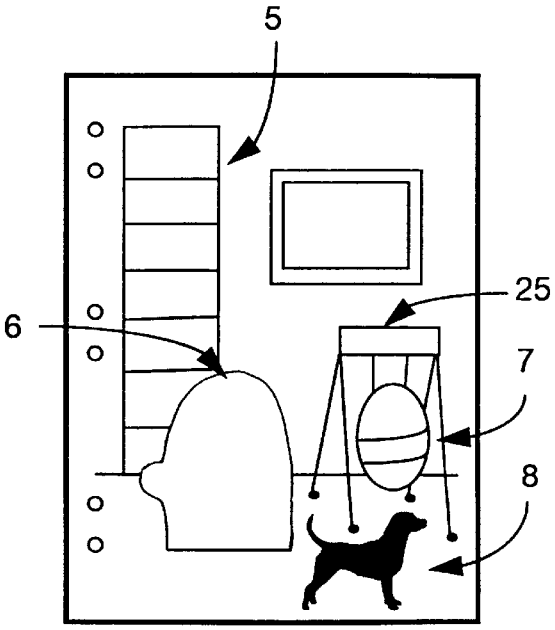

FIG. 2 and FIG. 3 depict a family room. The bookshelves 3 & 5, TV 4 and baby swing 25, are painted or printed on the page material. The couch 2 and chair 6 are pieces of material that have been cut in those shapes and attached on the two sides and bottom with tops left open to insert dolls. The dolls will have their heads and necks in view so they appear to be sitting on the couch 2 or in the chair 6. The baby doll will slip into the strap 7 on the doll swing 25. The pet 8 is made of a furry material and attached by Velcro. In each room of this Dollhouse book there will be a Velcro strip somewhere for the pet to be attached to.

Figure 4:
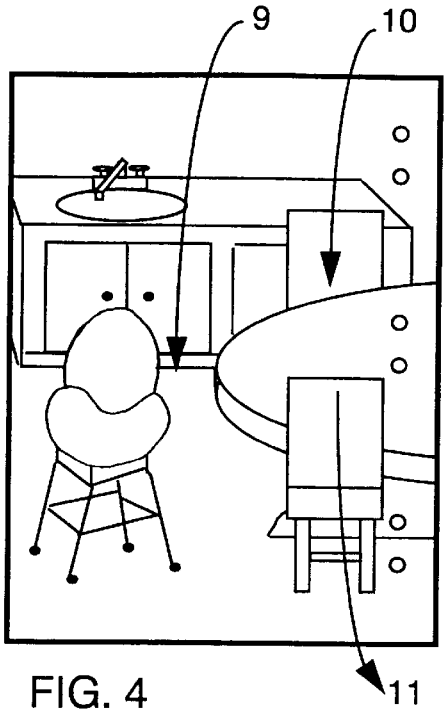
FIGS. 4 & 5—Kitchen
Figure 5:
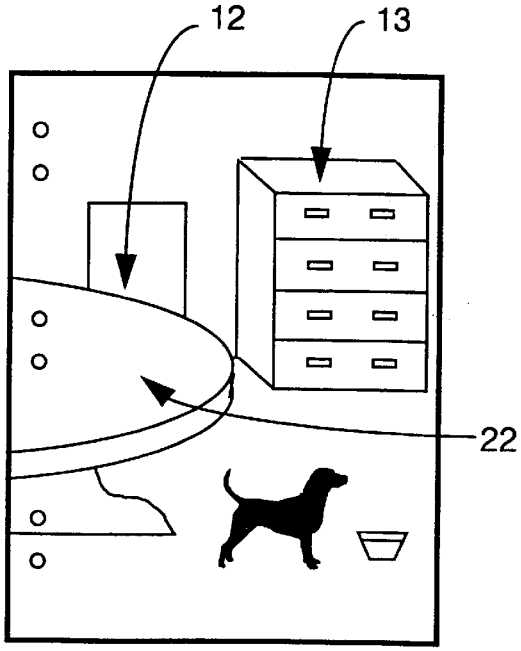

FIG. 4 and FIG. 5 is the Kitchen. On these pages the Kitchen table 22 is a separate piece of material that has been attached to the page on the sides and bottom with two openings 10 & 12 left to insert two dolls. The chair at the bottom of the page in FIG. 4 is also a separate piece of material attached on two sides and bottom with opening left 11 for a doll to be inserted. The high chair's Tray 9 is a strap to hold the baby doll in place. The China cabinet, which is a separate piece of material also, has a pocket 13 to be used for table's place settings 23 to be stored. The Table and place settings are made of a flannel or felt like material so the place settings will stay in place when set on the table. The pet has a Velcro strip by it's feed dish.

Figure 6:
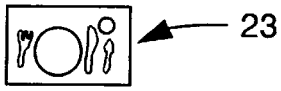
FIGS. 6 & 7—Master bedroom
Figure 6:
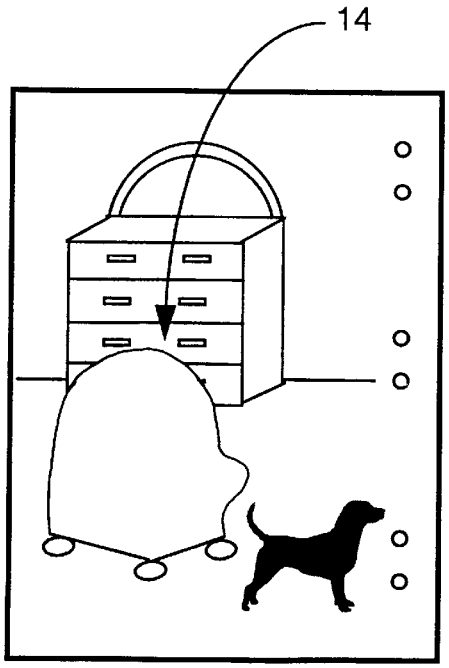
Figure 7:
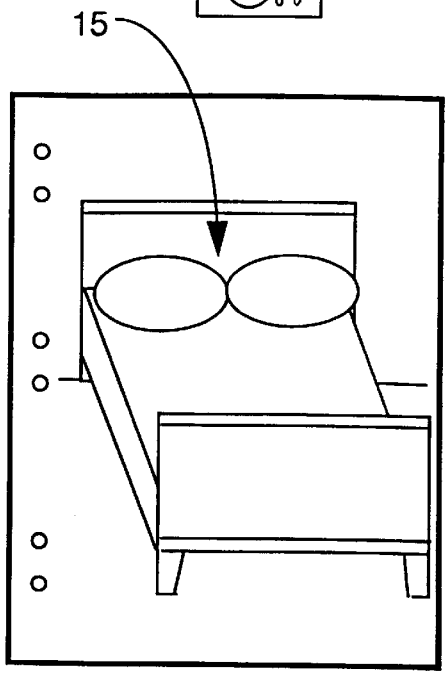

FIG. 6 & FIG. 7 depict the Master bedroom. The dresser, night stand and bed headboard have been painted or printed onto the pages. The chair is a separate piece of material with a pocket 14 for a doll to be inserted. The bed is also a separate piece of material with a double pocket so the Mother doll and Father doll can be placed in them. Velcro strip for pet is by chair.

Figure 8:
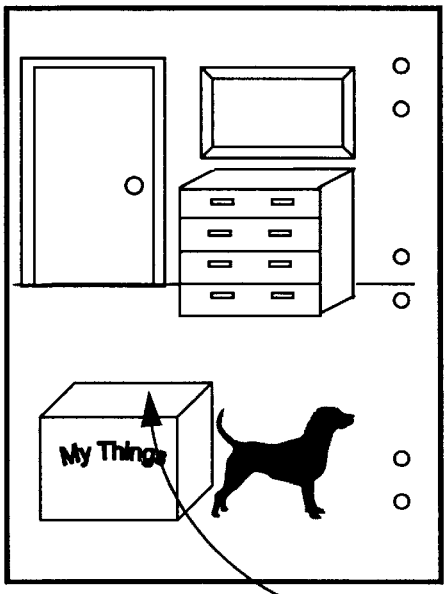
FIGS. 8 & 9—Big sister's room
Figure 9:
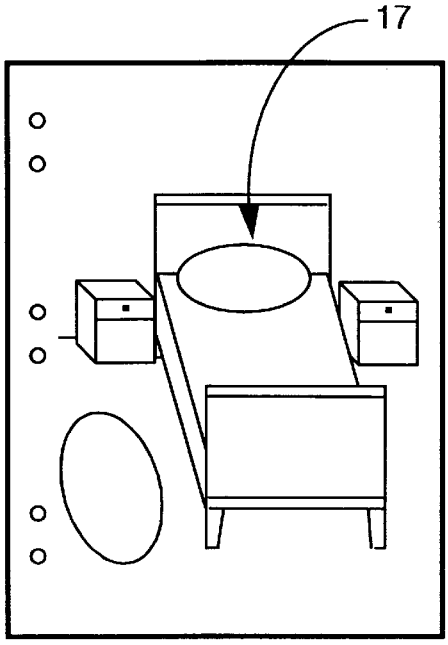

FIG. 8 & FIG. 9 show the Big sister's bedroom. The dresser, night stands, rug, door, and bed headboard are painted or printed on the pages. The "My Things" chest is a separate piece of material made into a pocket with an opening 16 into which Big sister's things can be stored. The bed is a pocket with an opening 17 into which the girl doll may be placed. The pet's Velcro strip is by chest.

Figure 10:
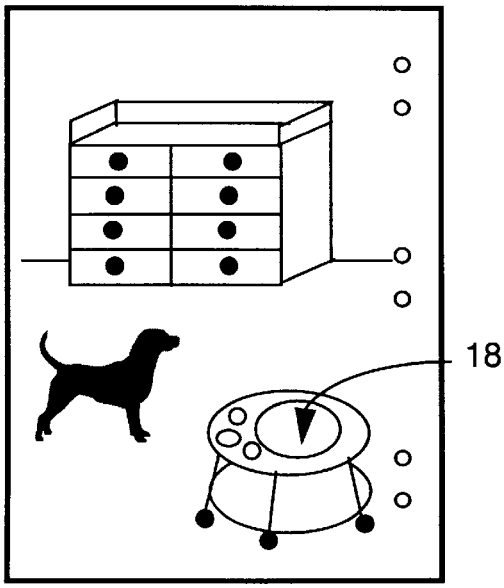
FIGS. 10 & 11—Nursery
Figure 11:
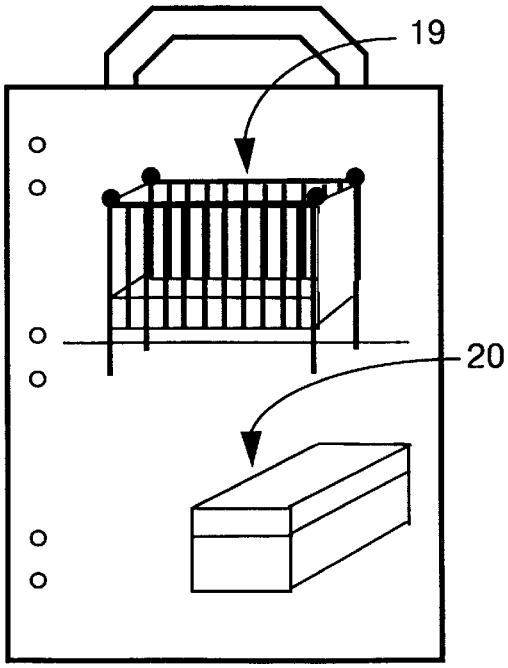

FIG. 10 & FIG. 11 depict the Nursery. The baby walker 18 is painted or printed on page except the top of the walker which is a separate piece of material with a hole cut out of center in which the baby doll can be inserted. The top of walker is attached to page at the upper side with rest of walker top left free to come away from the page a little when baby is inserted. The crib front is a clear material with the crib rungs painted on it. The rest of the crib is painted or printed on page. The clear material forms a pocket with opening at top 19. When baby is lain in the crib, it can be seen through the clear material. The "Toys" chest is a separate piece of material made into a pocket with an opening 20. Baby's toys may be stored here. The Pet has a Velcro strip by walker.

As you can see this is an invention that could easily be enjoyed by a small child. In this fast pace society that we live in it's being very portable is a wonderful quality. I have throughout the description mentioned members of a dollhouse family [Father, Mother, Big sister, and Baby], but do not have them drawn. There are several wonderful dollhouse families on the market. I plan to scale the book to be used with two of the more popular ones. But this should not be construed as limiting the scope of the invention. The scope of the invention should be determined by the appended claims, rather then by the examples given.

I imagine this invention to be a popular item to be taken along for car trips, Dentist & Doctor appointments, to church, etc. I have enjoyed this creative effort and am excited about the possibilities.

I claim:

1. A dollhouse activity book comprising: A front cover; a back cover; a plurality of pages disposed between said front cover and said back cover; each of said pages having indicia representative of a room of a house; a plurality of separate figures shaped and designed with indicia which is associated with said indicia representative of a room of a house for each of said plurality of pages; each of said pages having two sides, each of said sides including at least one pocket, configured and arranged to receive one of said plurality of separate figures therein; some of said plurality of pages further including a strap, said strap comprising a strip of material attached to said page at two ends and adapted to receive and secure one of said separate figures between said page and said strap; and wherein each of said pockets and said strips are designed as an integral part of said indicia representative of a room of a house and wherein each of said separate figures are designed and dimensioned to be received within said pockets and said straps such that they correspond to the representation of the room of the respective page.

* * * * *